US007275941B1

(12) United States Patent
Bushby

(10) Patent No.: US 7,275,941 B1
(45) Date of Patent: Oct. 2, 2007

(54) LOCKABLE PORTABLE MEMORY STORAGE DEVICES WITH SERIAL BUS CONNECTORS AND LOCKING SYSTEM THEREFOR

(76) Inventor: Donald P. Bushby, 1211 Nagle St., Houston, TX (US) 77003

( * ) Notice: Subject to any disclaimer, the term of this patent is extended or adjusted under 35 U.S.C. 154(b) by 0 days.

(21) Appl. No.: 11/474,693

(22) Filed: Jun. 26, 2006

Related U.S. Application Data

(60) Provisional application No. 60/709,663, filed on Aug. 19, 2005, provisional application No. 60/708,275, filed on Aug. 15, 2005.

(51) Int. Cl.
*H01R 13/44* (2006.01)

(52) U.S. Cl. ..... 439/133

(58) Field of Classification Search ..... 439/304, 439/680, 133, 135, 131; 361/752
See application file for complete search history.

(56) References Cited

U.S. PATENT DOCUMENTS

| | | | | |
|---|---|---|---|---|
| 5,435,744 | A | 7/1995 | Derstine et al. | |
| 5,502,989 | A | 4/1996 | Murray, Jr. et al. | |
| 5,507,656 | A * | 4/1996 | Ales | 439/133 |
| 5,601,440 | A * | 2/1997 | Richter | 439/134 |
| 5,634,809 | A | 6/1997 | Hirai | |
| 5,772,461 | A | 6/1998 | Yu | |
| 5,944,550 | A * | 8/1999 | Vindigni | 439/333 |
| 6,178,089 | B1 * | 1/2001 | Alfonso et al. | 361/727 |
| 6,522,534 | B1 * | 2/2003 | Wu | 361/686 |
| 6,619,976 | B2 | 9/2003 | Huetter et al. | |
| 6,808,400 | B2 | 10/2004 | Tu | |
| 6,902,432 | B2 | 6/2005 | Morikawa et al. | |
| 6,999,322 | B1 * | 2/2006 | Lin | 361/752 |
| 7,104,814 | B1 * | 9/2006 | She et al. | 439/131 |
| D532,783 | S * | 11/2006 | Yu | D14/356 |
| 2004/0074264 | A1 | 4/2004 | Kung et al. | |
| 2006/0004974 | A1 | 1/2006 | Lin et al. | |
| 2006/0036872 | A1 | 2/2006 | Yen | |

* cited by examiner

*Primary Examiner*—Tulsidas C. Patel
*Assistant Examiner*—Harshad C Patel
(74) *Attorney, Agent, or Firm*—Kenneth A. Robby

(57) ABSTRACT

Lockable portable memory storage devices equipped with male connector plugs have a locking system that prevents access to, and connection of the connector to external devices, and thereby prevents unauthorized use of the device and access to data and/or media stored thereon. The locking system may be incorporated in portable memory devices having a cap or cover that fits over the end of the male plug, a connector plug that pivots relative to its cover or sheath, and devices having a connector plug that is extensible and retractable relative to its cover or sheath; and allows a locking device to be installed on the housing or sheath of the memory storage device, or between the housing and the cover, cap, or sheath that encloses or covers the connector to prevent exposure of the connector to an extent that would allow connection and use of the device.

28 Claims, 3 Drawing Sheets

LOCKABLE PORTABLE MEMORY STORAGE DEVICES WITH SERIAL BUS CONNECTORS AND LOCKING SYSTEM THEREFOR

CROSS REFERENCE TO RELATED APPLICATIONS

This application claims priority of U.S. Provisional Application Ser. No. 60/708,275, filed Aug. 15, 2005, and U.S. Provisional Application Ser. No. 60/709,663, filed Aug. 19, 2005.

BACKGROUND OF THE INVENTION

1. Field of the Invention

This invention relates generally to security systems for portable memory storage devices, and more particularly to lockable portable memory storage devices equipped with serial bus connectors and a locking system therefor that prevents access to, and connection of the connector to external devices, and thereby prevents unauthorized use of the device and access to data and/or media stored thereon, and when coupled with a security cable, also prevents theft of the memory storage device.

2. Background Art

As used herein, the term "portable memory storage device" refers to small portable devices having the capability to store large amounts of digital data and/or media, and are equipped with a connector plug such as, for example, a Universal Serial Bus (USB) connector or Firewire® connector for uploading or downloading digital data and/or media between the memory device and a computer or other device. These portable memory storage devices are capable of storing data files, image files, music files, and video files.

Examples of portable memory storage devices include: "flash drives", also known as "thumb drives", "flash disks" or "pen drives", "mini hard drives", and portable audio players, portable video players, digital cameras, personal digital assistants (PDA), cell phones, and portable Firewire® compatible devices.

These types of portable memory storage devices have increased dramatically in capability and popularity, while decreasing in size and expense. Due to their small size, these types of devices are also susceptible to theft or misplacement, and moreover, unauthorized use and/or downloading valuable files, digital data and/or media stored thereon by simply connecting the device to a computer or other device, without detection by the owner.

There are currently five different types of Universal Serial Bus (USB) male plug connectors in standard sizes, known as a "USB-A-Male", "USB-B-Male", "Mini USB-A-Male" and "Mini USB-B-Male". A Firewire® connector is an IEEE1394 compliant High Performance Serial Bus that provides two types of data transfer: asynchronous and isochronous, and is typically employed as an audio-visual connector. Asynchronous data transfer is for traditional load-and-store applications where data transfer can be initiated and an application interrupted as a given length of data arrives in a buffer. Isochronous data transfer ensures that data flows at a pre-set rate so that an application can handle it in a timed way while providing the bandwidth needed for audio, imaging, video, and other streaming data.

Most conventional portable memory storage devices of the type discussed above equipped with a male connector plug include a means of covering the plug to protect it from damage and prevent accumulation of dirt or debris. For example; simple covers or caps that slip over the end of the male connector plug, a pivotal cover or sheath that encloses the male plug when stored and allows it to pivot outward therefrom to expose the plug for use, and a retractable cover or sheath which allows the male connector plug to be retracted inside the sheath in a stored position and is extensible outwardly therefrom for use. These types of covers, caps and sheaths, do not prevent unauthorized access to, and/or connection of the connector plug to external devices, nor prevent unauthorized access to the data and/or media stored in the device memory, nor prevent theft of the device.

There are several known devices for tethering or securing the portable memory device to a stationary object, such as a desk, workstation, or computer housing or case to prevent theft or misplacement of the memory device. A popular commercially available cable system is made by Kensington, of San Mateo, Calif. and described in U.S. Pat. No. 5,502,989. The cable is terminated at one end with a securing attachment to an anchor point on the valuable item and the other cable end is terminated with a locking device that attaches securely to the anchor point. The steel cable is arranged to loop around some large, preferably immovable object thus rendering the valuable item more difficult to steal.

Kung, U.S. Published Patent application 20040074264 discloses a portable data storage device, such as a pen drive or thumb drive, having a latching device that captures and traps a key-ring or security cable passing through the end opposite the USB plug that securely attaches the data storage device to deter theft of the storage device, without the need to unlock the security cable's lock.

While these types of tethering devices may be effective in preventing theft, removal, or misplacement of the memory device, they do not prevent unauthorized access to, and/or connection of the connector to external devices and thus, do not prevent theft the data and/or media stored in the device memory. An unauthorized person could still use and/or download valuable files, digital data and/or media stored on the memory device by simply connecting it to a laptop computer or other host device, without detection by the owner.

There are also several known methods employed for securing or preventing theft of the data or media stored on portable memory devices, which include: encryption, password protection, and biometric identification devices and methods. Although these methods are may be suitable for preventing unauthorized access to the data and/or media stored on the device, they do not prevent unauthorized access to and/or connection to the USB connector.

Lin, U.S. Published Patent application 20060004974 discloses a portable non-volatile memory device and method for preventing unauthorized access to data stored thereon without requiring self-installing software to protect the stored data. The device is activated when it is coupled to a computer and generates a window on the computer screen. A Graphical User Interface requests authentication information for accessing data stored on the device. If the correct authentication information is input, then access to the data stored on the device is granted; otherwise access to the data is denied.

Yen, U.S. Published Patent application 20060036872 discloses an anti-burglary USB flash drive with a press-button type electronic combination lock that adopts an IC password circuit without requiring a driver program for achieving the effects of preventing burglary and protecting confidential data stored in the USB flash drive by means of entering a password into a main body of the USB flash drive. A programmable logic IC in the main body of the USB flash drive checks the password, and if the password is correct, then the user is permitted to access the data stored in the USB flash drive.

Morikawa et al, U.S. Pat. Nos. 7,014,490 and 6,902,432 discloses a USB connector equipped with a latching or lock mechanism. The USB connector includes a receptacle having a shell and a receptacle terminal; a plug that includes a plug shell for fitting into the receptacle shell and a plug terminal; and an engagement release member that is provided on the plug shell so as to be movable between an engagement releasing position and an engagement position. When the plug is fitted into the receptacle, the plug terminal is electrically connected to the receptacle terminal. The plug shell has a retaining portion and the receptacle shell has an engagement portion, which is engaged with the retaining portion when the plug is fitted into the receptacle. The engagement release member maintains engagement of the retaining portion with the engagement portion in an engagement position, and the release member releases the engagement in an engagement releasing position.

Huetter et al, U.S. Pat. No. 6,619,976 discloses an apparatus and method for preventing inadvertent disconnection of male and female electrical connectors. In one embodiment, the devices are configured to provide outside retaining forces to retention prongs of a female electrical connector, substantially restricting or preventing the retention prongs from moving toward an outer non-holding position after connecting with receiving portions in the male connector. In another embodiment, the female electrical connector includes modified retention prongs having a portion configured to enter and remain in surface holes of the male connector so that the male connector, once inserted, cannot be removed from the female connector without a user manipulating the modified retention prongs.

Yu, U.S. Pat. No. 5,772,461 discloses a locking mechanism for interconnecting two mated connectors. A first receptacle connector includes a first main body having a first projecting section on the front portion, and a second plug connector includes a second main body having a second projecting section on the front portion wherein a hook device is provided on the first projecting section of the first receptacle connector and a locking slot is provided on the second projecting section of the second plug connector, and said second projecting section of the second plug connector further includes a release device which can incorporate the hook device of the first projecting section of the first receptacle connector to unhook the engagement between the hook of the first projecting section of the first receptacle and the locking slot of the second projecting section of the second plug connector.

Hirai, U.S. Pat. No. 5,634,809 discloses a connector with a lock mechanism having a connector main body in which are mounted electric contacts, a shield member for covering the connector main body and a connecting portion between the electric contacts and a cable, a casing for enclosing the connector main body and the shield member; and a lock mechanism for locking or unlocking a connection of the connector to a mating connector. The lock mechanism is made up of a flexible lock piece, one end of which is connected to the shield member; a pair of lock release slide plates which are slidable along upper and lower main surfaces of the casing; and slide members which slide inside the casing by sliding of the slide plates so as to release the locking by the lock piece.

Derstine et al, U.S. Pat. No. 5,435,744 discloses an overlying sliding boot assembly or cover for an electrical cable connector of the type that mates with and latchably engages a complementary connector. The connector includes a dielectric housing containing an array of electrical contacts for electrical engagement with respective contacts in a complementary connector. The connector further comprises a pair of unitary metal shielding members, a first one has a pair of latching arms extending from a mating end toward a cable receiving end, and a pair of hermaphroditic cover members formed of a dielectric material adapted to interfit together about the electrical connector in sliding engagement therewith, and movable from a first position to a second position to effect unmating of the electrical connector from the header assembly. Each cover member includes a latching arm receiving recess, and a flexible arm engageable with a complementary recess in the opposing cover member. Manual movement of the assembled cover members to the second position causes the respective flexible arms to flex from their released position. Releasing the assembled cover members effects a return of the assembled cover members to the first position.

The covers and locking arrangements of the aforesaid patents and published applications are lock mechanism that merely operate to lock or unlock the connector to a mating connector to hold them together and prevent accidental detachment. They do not prevent unauthorized access to and/or connection of the connector to an external device, nor prevent unauthorized access to the data and/or media stored on the device equipped with the mating connector.

The present invention overcomes the aforementioned problems and is distinguished over the prior art in general, and these patents in particular by lockable portable memory storage devices equipped with serial bus connectors and a locking system therefor that prevents access to, and connection of the connector to external devices, and thereby prevents unauthorized use of the device and access to data and/or media stored thereon. The present locking system allows a locking device to be installed on the body or housing of the memory storage device, or between the housing and a cover, cap, or sheath that encloses or covers the connector to prevent exposure of the connector to an extent that would allow connection and use of the device. The present system and method may be incorporated in portable memory devices having a cap or cover that fits over the end of the male connector, a connector that pivots relative to its cover or sheath, and devices having a connector that is extensible and retractable relative to its cover or sheath. The present system and method may also be utilized in conjunction with conventional security cables and locking devices to also prevent theft of the memory storage device.

SUMMARY OF THE INVENTION

The present invention concerns lockable portable memory storage devices having a housing, memory storage means in the housing for storing digital data, a connector plug interconnected with the memory storage means adapted to be connected to an external device for accessing and transferring digital data between the memory storage means and external device; and lockable and unlockable cover means associated with the housing for covering at least a portion of the connector plug. The cover means, in an unlocked condition, allows connection of the connector plug to the external device and, in a locked condition, covers at least a portion of the connector plug to prevent connection of the connector plug to the external device and, thereby prevents unauthorized access to data and media stored in the memory.

The locking system of the present lockable portable memory storage devices allows the portable memory storage devices to be locked with a conventional locking device such as a padlock, combination lock, cable lock, or security cable.

The lockable portable memory storage devices of the present invention, in a locked condition can also be coupled with a security cable, which is securely anchored to another object to prevent the unauthorized removal or theft of the portable memory storage device.

The locking system of the present invention may be incorporated into portable memory storage devices of the type having a cap or cover that fits over the end of the male plug connector, a male plug connector that pivots relative to its housing or an outer sheath, and portable memory devices having a connector that is extensible and retractable relative to its housing or an outer sheath.

The locking system of the present invention may also be used in conjunction with other existing forms of portable memory security including encryption software, password protection, and biometric identification devices and methods.

The present lockable portable memory storage device and a security lock may be packaged and sold together as a kit for the convenience of the consumer.

Other objects and advantages of the invention will become apparent from time to time throughout the specification and claims as hereinafter related.

BRIEF DESCRIPTION OF THE DRAWINGS

The novel features believed to be characteristic of the invention are set forth in the appended claims. The present invention itself, however, as well as a preferred mode of use, further objectives, and advantages thereof, will best be understood by reference to the following detailed description of preferred embodiments when read in conjunction with the accompanying drawings.

DESCRIPTION OF THE PREFERRED EMBODIMENTS

Figure 1:
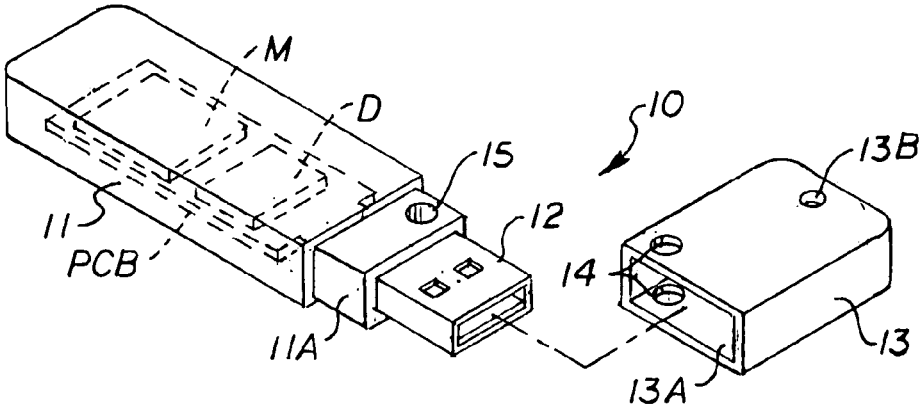
FIG. 1 is an exploded isometric view of a first embodiment of the portable memory storage device of the type having a cover or cap that fits over the end of the male connector plug, shown in an unlocked position with the cap removed.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner. The male connector plug depicted in the drawing figures is shown and described, for purposes of example only, as a Universal Serial Bus (USB) plug, and it should be understood that the connector plug may be of any type that is interconnected with the memory storage member of the portable memory storage devices and adapted to be connected to an external device for accessing and transferring digital data between the memory storage and external device.

It should also be understood that the embodiments of the portable memory storage devices described herein, the interior components, electronic circuitry, and connector plug details are of standard conventional construction and well known in the art, and therefore, are represented somewhat schematically and not shown or described in detail.

The portable memory storage devices of the type discussed herein include a main body or housing in which is housed one or more printed circuit boards (PCB), which include a memory means M such as a memory IC (integrated circuit) or a memory chip or disk, a driver IC D, and a standard serial bus male connector plug such as, for example, a USB (Universal Serial Bus) connector plug or a Firewire® connector plug. The male connector plug may be mounted or connected at one end with the PCB, and a part of the plug protrudes through an opening at one end of the body or housing, or is movable relative thereto, to be inserted into a mating female socket or port on an external device, such as a computer or other device for transferring digital data between the memory storage and external device.

Removable Cap Embodiment

Figure 2:
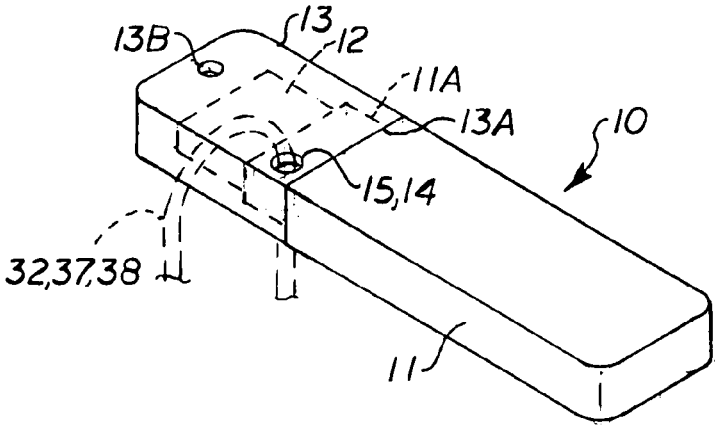
FIG. 2 is an isometric view of the memory storage device of FIG. 1, shown in the locked position with the cover or cap secured over the end of the male connector plug and locked thereon by a shackle or a cable of a locking device shown in dashed line.

Referring to the drawings by numerals of reference, there is shown in FIGS. 1 and 2, a first preferred embodiment of the portable memory storage device 10 of the type having a cover or cap 13 with an open end 13A that fits over the end of the male connector plug 12, which is shown for purposes of example, as a USB (Universal Serial Bus) connector plug. In this embodiment, the body or housing 11 of the memory device 10 has a reduced neck portion 11A that surrounds the male connector plug 12 and on which the cap 13 may be frictionally engaged to cover the plug. The cap 13 and the reduced neck portion 11A of the body 11 are each provided with a hole 14 and 15, respectively, that extends through the cap and neck portion. The holes 14 and 15 are positioned so as not to interfere with any of the electronic circuitry or latching elements of the connector, and to become axially aligned when the cap 13 is pressed onto the reduced neck portion 11A of the body 11. The cap 13 may also be provided with an eyelet or hole 13B for receiving a keychain, tethering cable or security cable.

Figure 3:
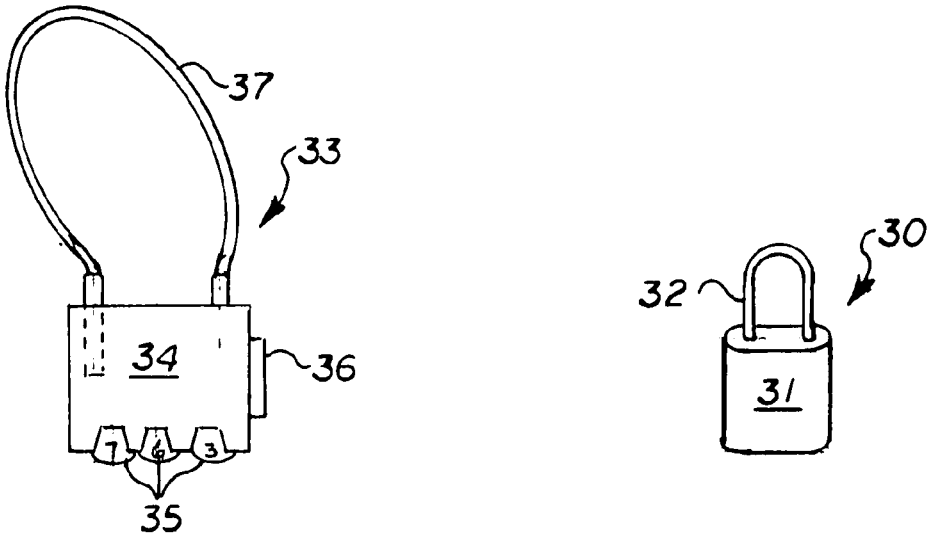
FIG. 3 is a perspective view of a conventional padlock, and a cable lock, which may be used to lock the cover or cap and the body or housing of the memory device together.

Referring additionally to FIG. 3, there is shown a conventional padlock 30 having a case 31 and U-shaped metal shackle 32, and a cable lock 33 having a case 34 with rotatable code number dials 35, a release button 36, and a flexible cable 37, either of which may be used to lock the cover or cap 13 and the body 11 of the memory device together. The padlock 30 and cable lock 33 are conventional and well known in the art, and therefore not shown or described in detail. It should be understood that either of the locks may have a key type or combination type or other type of opening mechanism.

As shown in dashed line in FIG. 2, when the cap 13 is installed, a locking device, such as the shackle 32 of the padlock 30, or the cable 37 of the cable lock 33 (FIG. 3) is installed through the aligned holes 14, 15 to prevent the cap 13 from being removed from the device body 11 and, thus, prevent access to and connection of the connector plug to an external device and unauthorized access to data and media stored in the memory. It should be understood, that, alternatively, a conventional security cable 38 may be installed through the aligned holes to prevent the cap from being removed. Optionally, a security cable may be coupled to the shackle or cable of the lock, whereby the memory device secured by the lock in its locked condition can also be secured to another object, such as a computer, desk, briefcase, purse, etc.

Hinged Cap Embodiment

Figure 4:
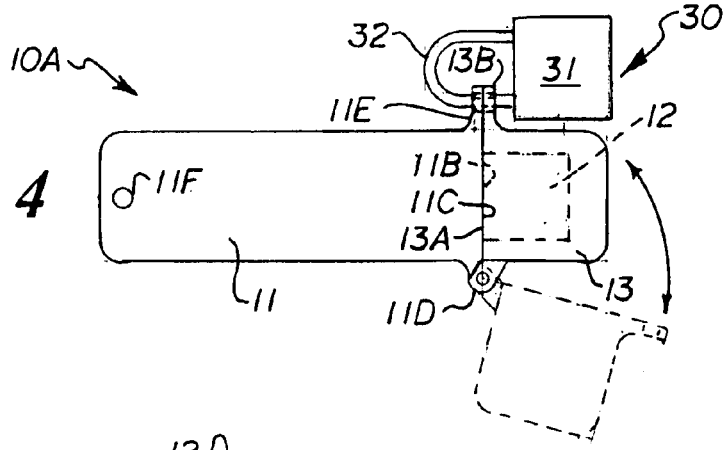
FIG. 4 is a top plan view of a second embodiment of the portable memory storage device of the type having a hinged cap that pivots relative to the body or housing of the device to expose the male connector plug.

FIG. 4 shows a second embodiment of the portable memory storage device 10A of the type having a hinged cap that pivots relative to the body or housing of the device to expose the male connector plug 12, which is shown for purposes of example, as a USB (Universal Serial Bus) connector plug. In this embodiment, the body or housing 11 of the memory device 10A has an opening 11B at one end 11C through which the outer portion of the plug 12 protrudes. The body or housing 11 has a hinge connection 11D on one side and an eyelet 11E extends from the opposed side adjacent to the opening in the body or housing. The cover or cap 13 has an open end 13A and is pivotally connected on one side to the hinge connection 11D, and has an eyelet 13B extending from the opposed side adjacent to its open end to be superposed on the eyelet 11E of the body or housing 11. The cap 13 is pivotal between an open position to expose, and allow use of, the male connector plug 12, and a closed position enclosing the plug.

When the cap 13 is closed, the eyelets 11E and 13B are superposed and the holes of the eyelets are axially aligned. The shackle 32 of a padlock 30 or the cable 37 of a cable lock 33 (FIG. 3) is installed through the aligned holes of the eyelets 11E, 13B to prevent the cap 13 from being pivoted to an extent that would allow full exposure, and access to the male connector plug 12. As with the previous embodiment, a security cable may optionally be secured to the shackle or cable of the lock, whereby the memory device secured by the lock can also be secured to another object, such as a computer, desk, briefcase, purse, etc. Alternatively, the closed end of the body or housing 11 may be extended and provided with a hole 11F therethrough for receiving a tethering cable or a keychain for attachment to other objects.

Rotary Cover Embodiment

Figure 5:
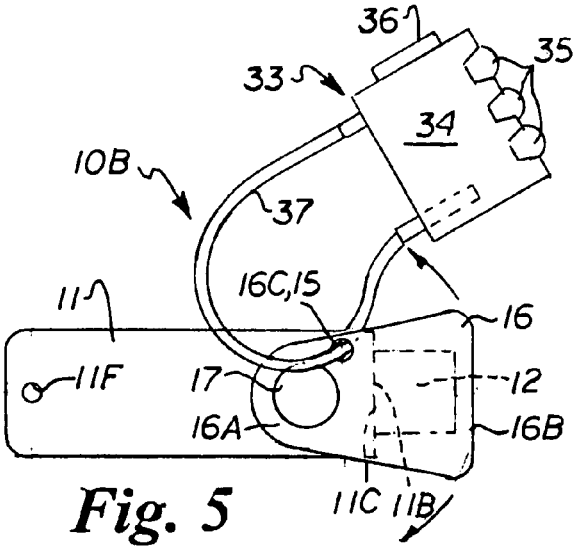
FIG. 5 is a top plan view of another embodiment of the portable memory storage device, similar to FIG. 4 having a hinged cover or sheath that pivots relative to the body or housing of the device to expose the male connector plug.

FIG. 5 shows another embodiment of the portable memory storage device 10B, similar to FIG. 4, but having a hinged cover or sheath that pivots relative to the body or housing of the device to expose the male connector plug, rather than a cap. In this embodiment, the body or housing 11 of the memory device 10B has an opening 11B at one end 11C through which the outer portion of the connector plug 12 protrudes. An elongate sheath or cover 16 is pivotally mounted on the body or housing 11. The cover 16 has a generally U-shaped transverse cross section with a pair of flat sides 16A that straddle the body or housing 11, and an outer end portion 16B that extends over the outer end of the male connector plug 12. The flat sides 16A of the cover 16 are pivotally connected near their lower ends to the opposed sides of the body or housing 11, respectively by a pivot connection 17. Thus, the cover 16 is pivotal to either side of the housing 11 between an open position to expose, and allow use of, the male plug 12, and a closed position extending over the exposed end of the male plug. The flat sides 16A of the cover 16 are each provided with axially aligned holes 16C near one side, and the housing 11 is provided with a hole 15 that extends therethrough. The holes 16C and 15 are positioned so as to become axially aligned when the cover 16 is pivoted into the closed position over the outer end of the plug 12, and the hole 15 is positioned so as not to interfere with any of the electronic circuitry or latching elements of the connector plug.

When the cover 16 is closed, the holes 16C and 15 are superposed and axially aligned. The cable 37 of a cable lock 33 or the shackle 32 of a padlock 30 (FIG. 3) is installed through the aligned holes of the of the cover 16 and body or housing 11 to prevent the cover 16 from being pivoted to an extent that would allow full exposure, and access to the male connector plug 12. As with the previous embodiments, a security cable may optionally be secured to the shackle or cable of the lock, whereby the memory device secured by the lock can also be secured to another object, such as a computer, desk, briefcase, purse, etc. It should be understood, that, alternatively, a conventional security cable may be installed through the aligned holes to prevent pivotal movement. The closed end of the body or housing 11 may also be extended and provided with a hole 11F therethrough for receiving a tethering cable or a keychain for attachment to other objects.

Pivotally Opening Embodiment

Figure 6A:
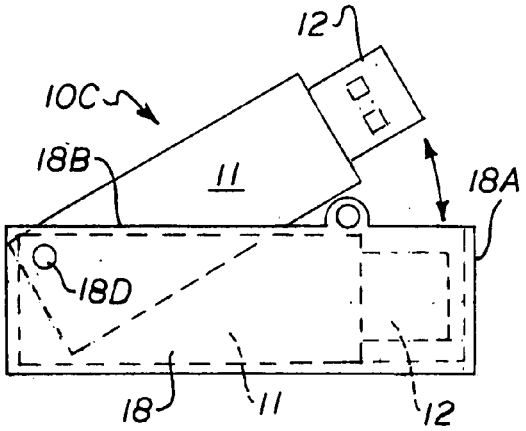
FIGS. 6A and 6B are a side view and a perspective view, respectively, of a third embodiment of the portable memory storage device of the type wherein the body or housing of the device and the cover or sheath pivot relative to one another to expose the male connector plug.
Figure 6B:
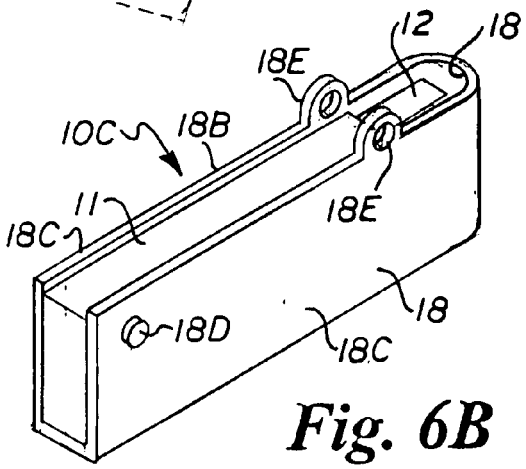

FIGS. 6A and 6B show a third embodiment of the portable memory storage device 10C of the type wherein the body or housing of the device and the cover or sheath pivot relative to one another to expose the male connector plug. In this embodiment, the body or housing 11 of the memory device is connected with an outer cover or sheath 18, having an open side through which the memory device pivots outwardly to expose the male connector plug 12. The outer cover or sheath 18 has a generally U-shaped transverse cross section with an enclosed end 18A and one open side 18B defining laterally spaced sides 18C that straddle the body or housing 11 with its enclosed end 18A extending over the outer end of the male plug 12 in the closed position. The sides 18C of the sheath 18 and body or housing 11 are pivotally connected near their ends opposite the male connector plug 12 by a pivot connection 18D disposed adjacent to the open side 18B. The sides 18C of the sheath 18 each have an outwardly extending eyelet 18E on each side of the open side 18B near the enclosed end 18A with their holes in axial alignment. The body or housing 11 of the memory device is pivotal outwardly through the open side 18B of the sheath 18 to an open position to expose, and allow use of, the male plug 12, and a closed position contained within the sheath with its enclosed end 18A extending over the outer end of the male plug.

When the body or housing 11 is in the closed position contained within the sheath 18, the shackle 32 of a padlock lock 30 or the cable 37 of a cable lock 33 (FIG. 3) is installed through the aligned holes of the eyelets 18E to prevent the body or housing from being pivoted outwardly to an extent that would allow full exposure, and access to the male connector plug 12. As with the previous embodiments, a security cable may optionally be secured to the shackle or cable of the lock, whereby the memory device secured by the lock can also be secured to another object, such as a computer, desk, briefcase, purse, etc. It should be understood, that, alternatively, a conventional security cable may be installed through the aligned holes to prevent pivotal movement.

Pivotal Connector Embodiment

Figure 7:
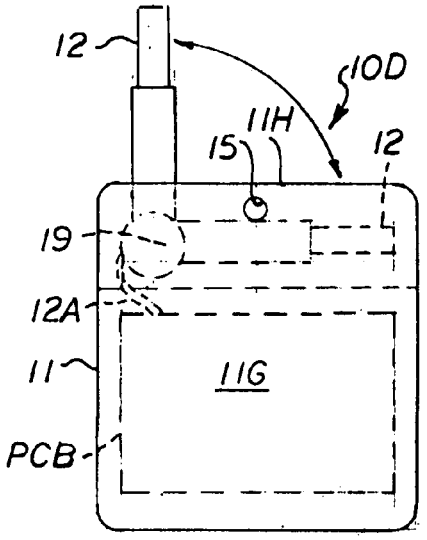
FIG. 7 is a top plan view of a fourth embodiment of the portable memory storage device of the type wherein the male connector plug pivots relative to the body or housing of the memory storage device.

FIG. 7 shows a fourth embodiment of the portable memory storage device 10D of the type wherein the male connector plug connector pivots relative to the body or housing of the memory storage device. This embodiment is similar to the pivotal memory device of FIGS. 6A and 6B previously described, but the male connector plug 12 is electrically connected to the internal PCB board by flexible leads 12A, rather than being secured directly to the PCB board. In this embodiment, the body or housing 11 of the memory device has a generally U-shaped transverse cross section with parallel front and back surfaces 11G and is enclosed on three sides and has an open side or end 11H, and the male connector plug 12 is pivotally mounted in the open end of the body or housing by a pivot connection 19 to pivot outwardly of the open side or end to expose, and allow use of, the male connector plug. In the closed position, the male connector plug 12 is disposed inside the body or housing 11 a short distance from the open side or end 11H. The front and back surfaces 11G of the body or housing 11 each have a hole 15 extending therethrough at the open end 11H in axial alignment. The holes 15 are positioned so as not to interfere with any of the electronic circuitry.

When the male connector plug 12 is in the closed position contained within the body or housing 11, the shackle 32 of a padlock lock 30 or the cable 37 of a cable lock 33 (FIG. 3) is installed through the aligned holes 15 to prevent the plug from being pivoted outwardly to an extent that would allow full exposure, and access to the plug. As with the previous embodiments, a security cable may optionally be secured to the shackle or cable of the lock, whereby the memory device secured by the lock can also be secured to another object, such as a computer, desk, briefcase, purse, etc. It should be understood, that, alternatively, a conventional security cable may be installed through the aligned holes to prevent pivotal movement.

Manually Removable Embodiment

Figure 8:
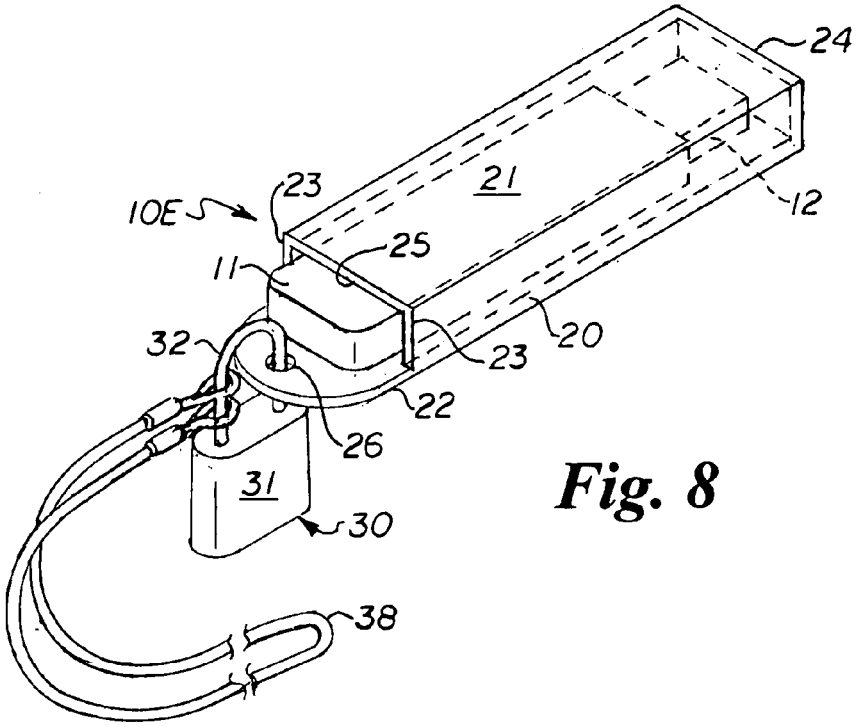
FIG. 8 is an isometric view of a fifth embodiment of the portable memory storage device of the type wherein the memory device is slidably received in a cover or sheath having an open end.

FIG. 8 shows a fifth embodiment of the portable memory storage device 10E of the type wherein the body or housing 11 of the memory device is slidably received in an outer cover or sheath 20 having an open end. The cover or sheath 20 has a generally rectangular transverse cross section with parallel top and bottom walls 21 and 22, parallel lateral side walls 23, an enclosed end 24, and an open end 25. The bottom wall 22 of the cover or sheath 20 protrudes a short distance beyond the open end 25 and has a hole 26 extending therethrough closely adjacent to the open end.

In a stored condition, the body or housing 11 of the memory device is received through the open end 25 of the sheath 20, and can be removed therefrom to expose, and allow use of, the male connector plug 12. When the body or housing 11 of the memory device is placed in the cover or sheath 20, the shackle 32 of a padlock 30 or the cable 37 of a cable lock 33 (FIG. 3) is installed through the hole 26 at the end of the sheath 20 to prevent the memory device from being extended outwardly from the open end or removed from the sheath and gaining access to the male connector plug 12. As with the previous embodiments, a security cable 38 may optionally be secured to the shackle 32 or cable of the cable lock, whereby the sheath 20 and memory device secured therein by the lock can also be secured to another object, such as a computer, desk, briefcase, purse, etc. It should be understood, that, alternatively, a conventional security cable may be installed through the hole to prevent removal of the memory device from the sheath.

Spring Biased Retractable Embodiment

Figure 9A:
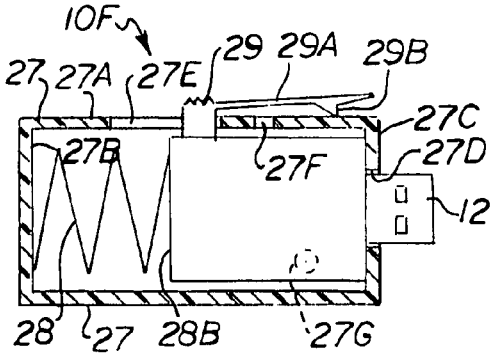
FIGS. 9A and 9B are longitudinal cross sectional views of a sixth embodiment of the portable memory storage device of the type wherein the male connector plug of the memory device is extensible and retractable relative to an outer cover or sheath.
Figure 9B:
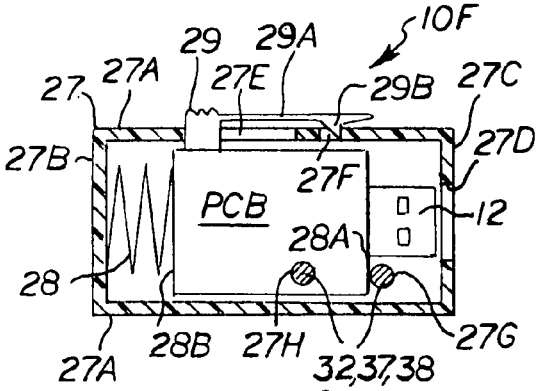

FIGS. 9A and 9B show a sixth embodiment of the portable memory storage device 10F of the type wherein the male connector plug connector of the memory device is extensible and retractable relative to an outer housing or sheath. The illustrated example of the extensible and retractable memory storage device is similar to the retractable device disclosed in Tu, U.S. Pat. No. 6,808,400, which is hereby incorporated by reference to the same extent as if fully set forth herein.

In this embodiment, the body or housing 27 of the memory device has a generally rectangular transverse cross section with parallel side walls 27A, and opposed end walls 27B and 27C, and the printed circuit board (PCB) of the memory device is slidably mounted in the body or housing. One end wall 27C has an opening 27D through which the male connector plug 12 is extensible and retractable. A compression spring 28 is disposed between the enclosed end 27B and the end 28B of the PCB of the memory device opposite the male plug 12. A sliding member 29 connected with the PCB extends through a slot 27E in the side wall of the body or housing 27, and has a resilient arm 29A with a latching element 29B engageable in an opening 27F adjacent to the slot 27E to normally maintain the connector plug 12 within the body or housing in a retracted position and the spring 28 under compression. When the latching element 29B is unlatched or disengaged from the opening 27F, the force of the spring 28 slides the PCB relative to the case to expose, and allow use of, the male connector plug 12.

Two of the opposed side walls 27A of the body or housing 27 have a hole 27G extending therethrough near the end wall 27C in axial alignment. The holes 27G are disposed in a position between the forward end 28A of the PCB and the opening 27D with the PCB in the retracted position. When PCB is in the retracted position, the shackle 32 of a padlock lock 30 or the cable 37 of a cable lock 33 (FIG. 3) is installed through the holes 27G in the side walls of the body or housing 27 to prevent the PCB from being extended forwardly to expose the plug 12 and allow access to and connection of the plug. Alternatively, the PCB may be provided with a hole 27H therethrough near its forward end which becomes axially aligned with the holes 27G in the side walls in its retracted position, and the shackle 32 or the cable 37 installed through the aligned holes 27G, 27H to lock the PCB in the retracted position. The hole 27H in the PCB is positioned so as not to interfere with any of the electronic circuitry. It should be understood that, alternatively, a conventional security cable 38 may be installed through the aligned holes to prevent extending the PCB and the male connector plug. As with the previous embodiments, a security cable may optionally be secured to the shackle or cable of the lock, whereby the memory device 10F secured by the lock can also be secured to another object, such as a computer, desk, briefcase, purse, etc.

Figure 10:
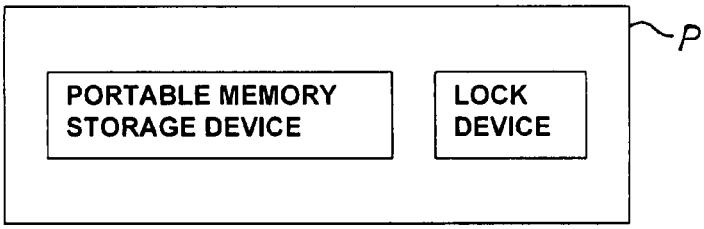
FIG. 10 is a schematic block diagram showing a portable memory storage device and a lock device therefor which may be provided together in combination as a kit.

As shown schematically in FIG. 10, the present lockable portable memory storage devices, (any one or more of the embodiments described above) and a security lock device (padlock or cable lock), may be provided together in combination in a package P and sold together as a kit for the convenience of the consumer.

The foregoing disclosure and description of the invention is illustrative and explanatory thereof. Various changes in the details of the illustrated construction and methods may be made within the scope of the appended claims without departing from the spirit of the invention. No limitations are intended to the details of construction or design, herein shown, or to the methods described herein, other than is described in the claims below. The present invention should only be limited by the following claims and their legal equivalents.

The invention claimed is:

1. A lockable portable memory storage device, comprising:

a portable memory storage device having a housing, memory storage means in said housing for storing digital data, and a connector plug interconnected with said memory storage means adapted to be connected to an external device for accessing and transferring digital data between the memory storage means and external device;

selectively lockable and unlockable cover means associated with said housing for covering and uncovering at least a portion of said connector plug; and lock receiving means on at least one of said cover means and said housing for receiving a locking device to secure said cover means in a covered locked condition; whereby said selectively lockable and unlockable cover means, in an unlocked condition, allows said portion of said connector plug to be covered or to be uncovered for connection to the external device and, in a covered locked condition, prevents unauthorized unlocking and uncovering of said portion of said connector plug and connection thereof to the external device and unauthorized access to data stored in said memory storage means.

2. The lockable portable memory storage device according to claim 1, wherein said connector plug comprises a serial bus male plug.

3. The lockable portable memory storage device according to claim 1, wherein said selectively lockable and unlockable cover means comprises a removable cap which, in the covered locked condition, is secured over and encloses at least an outer end of said connector plug to prevent unauthorized removal and, in the unlocked condition, is removable therefrom.

4. The lockable portable memory storage device according to claim 3, wherein said lock receiving means comprises apertures extending through respective side walls of said cap and said housing in a position to become axially aligned when said cap encloses said outer end of said connector plug for receiving either of a shackle or cable of a lock device, or a lockable security cable, therethrough to prevent unauthorized removal of said cap.

5. The lockable portable memory storage device according to claim 1, wherein said selectively lockable and unlockable cover means comprises a cap hingedly connected with said housing which, in the unlocked condition is movable to an open position to allow connection of said connector plug to the external device and, in the covered locked condition, is secured in a closed position enclosing at least an outer end of said connector.

6. The lockable portable memory storage device according to claim 5, wherein said lock receiving means comprises apertures extending through respective side walls of said cap and said housing in a position to become axially aligned when said cap is in said closed position for receiving either of a shackle or cable of a lock device, or a lockable security cable, therethrough to prevent unauthorized movement of said cap to the open position.

7. The lockable portable memory storage device according to claim 1, wherein said selectively lockable and unlockable cover means comprises a cover pivotally connected with said housing which, in the unlocked condition, is pivotal relative to said housing to an open position to allow connection of said connector plug to the external device and, in the covered locked condition, is secured to said housing in a closed position enclosing at least an outer end of said connector.

8. The lockable portable memory storage device according to claim 7, wherein said lock receiving means comprises apertures extending through respective side walls of said cover and said housing in a position to become axially aligned when said cap is in said closed position for receiving a shackle or cable of a lock device therethrough to prevent unauthorized movement of said cover to the open position.

9. The lockable portable memory storage device according to claim 1, wherein said selectively lockable and unlockable cover means comprises an outer sheath having an open side pivotally connected with said housing which, in the unlocked condition, allows pivotal movement of said housing and said connector plug to an open position extending outwardly from said sheath open side to allow connection of said connector plug to the external device and, in the covered locked condition, said housing and said connector plug are secured in a closed position within said sheath to prevent unauthorized connection of said connector plug to the external device.

10. The lockable portable memory storage device according to claim 9, wherein said lock receiving means comprises apertures extending through a pair of respective parallel spaced side walls of said outer sheath open side for receiving either of a shackle or cable of a lock device, or a lockable security cable, therethrough to prevent unauthorized movement of said housing and said connector plug to the open position.

11. The lockable portable memory storage device according to claim 1, wherein said selectively lockable and unlockable cover means comprises an outer sheath having an open end, and said housing and said connector plug are slidably received therein; and said outer sheath, in the unlocked condition allows removal of said housing and said connector plug therefrom to allow connection of said connector plug to the external device and, in the closed locked condition said housing and said connector plug are secured within said sheath to prevent unauthorized removal therefrom and connection of said connector plug to the external device.

12. The lockable portable memory storage device according to claim 11, wherein said outer sheath has at least one side wall adjacent to said open end; and said lock receiving means comprises an aperture extending through said at least one side wall for receiving either of a shackle or cable of a lock device, or a lockable security cable, therethrough to prevent unauthorized removal of said housing and said connector plug from said outer sheath.

13. The lockable portable memory storage device according to claim 1, wherein said selectively lockable and unlockable cover means comprises an outer sheath having an open end, and said housing and said connector plug are slidably mounted therein for extensible and retractable movement relative thereto; and said outer sheath, in the unlocked condition allows sliding movement of said housing and said connector plug to an open position with an outer end of said connector plug outer end protruding outwardly from said open end to allow connection of said connector plug to the external device, and in the covered locked condition said housing and said connector plug are secured in a closed position with said connector plug outer end disposed retracted within said sheath outer end to prevent unauthorized connection of said connector plug to the external device.

14. The lockable portable memory storage device according to claim 13, wherein said outer sheath has a pair of parallel spaced side walls; and said lock receiving means comprises respective axially aligned apertures extending through said parallel spaced side walls for receiving either of a shackle or cable of a lock device, or a lockable security cable, therethrough to prevent unauthorized movement of said housing and said connector plug to the open position.

15. The lockable portable memory storage device according to claim 1, wherein said selectively lockable and unlockable cover means comprises an open side of said housing, and said connector plug is pivotally connected with said housing to pivot between a closed position disposed within said open side and an open position pivoted outwardly therefrom; and in the unlocked condition, said connector plug is pivotal outwardly of said open side to the open position to allow connection of said connector plug to the external device and, in the covered locked condition, said connector plug is secured in the closed position within said open side to prevent unauthorized pivotal movement and connection of said connector plug to the external device.

16. The lockable portable memory storage device according to claim 15, wherein said open side of said housing has a pair of parallel spaced side walls; and said lock receiving means comprises respective axially aligned apertures extending therethrough for receiving either of a shackle or cable of a lock device, or a lockable security cable, therethrough to prevent unauthorized pivotal movement of said connector plug to the open position.

17. A security lock system for portable memory storage devices, comprising:

a portable memory storage device having a housing, memory storage means in said housing for storing digital data, and a connector plug interconnected with said memory storage means adapted to be connected to an external device for accessing and transferring digital data between the memory storage means and external device;

selectively lockable and unlockable cover means for covering and uncovering at least a portion of said connector plug; and locking means engageable with said cover means for securing said cover means in a covered locked condition which, in an unlocked condition, allows connection of said portion of said connector plug to be covered or to be uncovered for connection to the external device and, in a covered locked condition, secures said cover means in the covered locked condition covering said portion of said connector plug to prevent unauthorized unlocking and uncovering of said portion of said connector plug and access to and connection of said connector plug to the external device and unauthorized access to data stored in said memory storage means.

18. The security lock system according to claim 17, wherein said connector plug is a serial bus male plug.

19. The security lock system according to claim 17, wherein said selectively lockable and unlockable cover means comprises a removable cap which, in the covered locked condition, is secured over and encloses at least an outer end of said connector plug to prevent unauthorized removal and, in the unlocked condition, is removable therefrom;

said cap and said housing each have a side wall with respective apertures extending therethrough in a position to become axially aligned when said cap encloses said outer end of said connector plug; and said locking means is selected from the group consisting of a lock device having a shackle or cable, and a lockable security cable, said shackle or cable received through said axially aligned apertures to prevent unauthorized removal of said cap.

20. The security lock system according to claim 17, wherein said selectively lockable and unlockable cover means comprises a cap hingedly connected with said housing which, in the unlocked condition is movable to an open position to allow connection of said connector plug to the external device and, in the covered locked condition, is secured in a closed position enclosing at least an outer end of said connector;

said cap and said housing each have a side wall with respective apertures extending therethrough in a position to become axially aligned when said cap is in said closed position; and said locking means is selected from the group consisting of a lock device having a shackle or cable, and a lockable security cable, said shackle or cable received through said axially aligned apertures to prevent unauthorized movement of said cap to the open position.

21. The security lock system according to claim 17, wherein said selectively lockable and unlockable cover means comprises a cover pivotally connected with said housing which, in the unlocked condition, is pivotal relative to said housing to an open position to allow connection of said connector plug to the external device and, in the covered locked condition, is secured to said housing in a closed position enclosing at least an outer end of said connector;

said cover and said housing each have a side wall with respective apertures extending therethrough in a position to become axially aligned when said cap is in said closed position; and said locking means is selected from the group consisting of a lock device having a shackle or cable, and a lockable security cable, said shackle or cable received through said axially aligned apertures to prevent unauthorized movement of said cover to the open position.

22. The security lock system according to claim 17, wherein said selectively lockable and unlockable cover means comprises an outer sheath having an open side pivotally connected with said housing which, in the unlocked condition, allows pivotal movement of said housing and said connector plug to an open position extending outwardly from said sheath open side to allow connection of said connector plug to the external device and, in the covered locked condition, said housing and said connector plug are secured in a closed position within said sheath to prevent connection of said connector plug to the external device;

said outer sheath open side has a pair of parallel spaced side walls with respective axially aligned apertures extending therethrough; and said locking means is selected from the group consisting of a lock device having a shackle or cable, and a lockable security cable, said shackle or cable received through said axially aligned apertures to prevent unauthorized movement of said housing and said connector plug to the open position.

23. The security lock system according to claim 17, wherein said selectively lockable and unlockable cover means comprises an outer sheath having an open end, and said housing and said connector plug are slidably received therein;

said outer sheath, in the unlocked condition allows removal of said housing and said connector plug therefrom to allow connection of said connector plug to the external device and, in the covered locked condition said housing and said connector plug are secured within said sheath to prevent removal therefrom and connection of said connector plug to the external device;

said outer sheath has at least one side wall adjacent to said open end with an aperture extending therethrough; and said locking means is selected from the group consisting of a lock device having a shackle or cable, and a lockable security cable, said shackle or cable received through said at least on aperture to prevent unauthorized removal of said housing and said connector plug.

24. The security lock system according to claim 17, wherein said selectively lockable and unlockable cover means comprises an outer sheath having an open end, and said housing and said connector plug are slidably mounted therein for extensible and retractable movement relative thereto;

said outer sheath, in the unlocked condition allows sliding movement of said housing and said connector plug to an open position with said connector plug outer end protruding outwardly from said open end to allow connection of said connector plug to the external device, and in the covered locked condition said housing and said connector plug are secured in a closed position with said connector plug outer end disposed retracted within said sheath outer end to prevent connection of said connector plug to the external device;

said outer sheath has a pair of parallel spaced side walls with respective axially aligned apertures extending therethrough; and said locking means is selected from the group consisting of a lock device having a shackle or cable, and a lockable security cable, said shackle or cable received through said axially aligned apertures to prevent unauthorized movement of said housing and said connector plug to the open position.

25. The security lock system according to claim 17, wherein said selectively lockable and unlockable cover means comprises an open side of said housing, and said connector plug is pivotally connected with said housing to pivot between a closed position disposed within said open side and an open position pivoted outwardly therefrom;

in the unlocked condition, said connector plug is pivotal outwardly of said open side the open position to allow connection of said connector plug to the external device and, in the covered locked condition, said connector plug is secured in the closed position within said open side to prevent pivotal movement and connection of said connector plug to the external device;

said open side of said housing has a pair of parallel spaced side walls with respective axially aligned apertures extending therethrough; and said locking means is selected from the group consisting of a lock device having a shackle or cable, and a lockable security cable, said shackle or cable received through said axially aligned apertures to prevent unauthorized pivotal movement of said connector plug to the open position.

26. A method for preventing unauthorized access to data and/or media files stored in the memory of portable memory storage devices, comprising the steps of:

providing a portable memory storage device having a housing containing memory storage means for storing digital data, a connector plug interconnected with said memory storage means adapted to be connected to an external device for accessing and transferring digital data between the memory storage means and external device;

providing a selectively lockable and unlockable cover for covering and uncovering at least a portion of said connector plug;

selectively locking said cover in a covered locked position covering at least a portion of said connector plug to prevent unauthorized uncovering of said portion of said connector plug and access to and connection of said connector plug to the external device and unauthorized access to data stored in said memory storage means, and unlocking said cover to allow authorized uncovering of said portion of said connector plug and connection of said connector plug to the external device and access to data stored in said memory storage means.

27. The method according to claim 26, comprising the further step of:

coupling said portable memory storage device and said cover, in the covered locked position, with a security cable, and securely anchoring said security cable to prevent the unauthorized removal of said portable memory storage device.

28. A lockable portable memory storage device kit, comprising:

a portable memory storage device having a housing containing memory storage means for storing digital data, a connector plug interconnected with said memory storage means adapted to be connected to an external device for accessing and transferring digital data between the memory storage means and external device, and selectively lockable and unlockable cover means for covering and uncovering at least a portion of said connector plug in a covered locked condition; and a locking device adapted to be engaged with said cover means for selectively locking said cover means in a covered locked condition to prevent unauthorized uncovering of said connector plug and connection of said connector plug to the external device and unauthorized access to data stored in said memory means.

* * * * *